United States Patent [19]

Dunsmore

[11] 4,397,121

[45] * Aug. 9, 1983

[54] METHOD AND APPARATUS FOR REDUCING THE RATE OF HEAT TRANSFER

[76] Inventor: Howard L. Dunsmore, P.O. Box 13651, Reno, Nev. 89507

[ * ] Notice: The portion of the term of this patent subsequent to Sep. 30, 1997, has been disclaimed.

[21] Appl. No.: 191,904

[22] Filed: Sep. 29, 1980

Related U.S. Application Data

[63] Continuation-in-part of Ser. No. 928,866, Jul. 28, 1978, Pat. No. 4,224,771.

[51] Int. Cl.[3] ..... E04B 1/62; E06B 7/02; E06B 7/12

[52] U.S. Cl. ..... 52/1; 52/171; 52/173 R; 98/36; 165/1

[58] Field of Search ..... 52/171, 173, 1; 165/53, 165/1; 98/36

[56] References Cited

U.S. PATENT DOCUMENTS

| | | | |
|---|---|---|---|
| 3,014,814 | 12/1961 | McConica | 52/171 X |
| 3,192,575 | 7/1965 | Rosenau, Jr. et al. | 52/171 |
| 3,233,423 | 2/1966 | Beckwith et al. | 98/36 X |
| 3,356,824 | 12/1967 | Rossetti | 52/171 |
| 3,502,020 | 3/1970 | Bressickello | 98/36 X |
| 3,524,044 | 8/1970 | Liardi | 52/171 X |
| 3,590,913 | 7/1971 | Tschudin | 52/171 X |
| 3,659,551 | 5/1972 | McKinstry | 98/36 |
| 3,874,441 | 4/1975 | Duchene | 165/1 |
| 3,925,945 | 12/1975 | White | 52/788 X |
| 3,932,971 | 1/1976 | Day | 52/171 |
| 3,990,201 | 11/1976 | Falbel | 52/171 |
| 4,024,726 | 5/1977 | Furner | 52/171 X |
| 4,076,374 | 2/1975 | Schwab | 52/171 X |
| 4,224,771 | 9/1980 | Dunsmore | 52/171 |

FOREIGN PATENT DOCUMENTS

| | | | |
|---|---|---|---|
| 1155898 | 10/1963 | Fed. Rep. of Germany | 52/1 |
| 507916 | 7/1920 | France | 52/171 |
| 481991 | 3/1938 | United Kingdom | 98/36 |

*Primary Examiner*—Alfred C. Perham
*Attorney, Agent, or Firm*—Schapp and Hatch

[57] ABSTRACT

A method and apparatus for reducing the rate of heat transfer between adjacent bodies, at least one of which is a body of fluid responsive to forces tending to move the fluid along the interface between the bodies, the fluid adjacent to the interface being more responsive to such forces by reason of heat transfer across the interface. The method collects fluid displaced along an expanse of the interface, transports the collected fluid to the other side of the expanse, and discharges it there for repeated displacement across the expanse to again be collected. The apparatus includes one or more distributor means and one or more collector means at opposite sides of the expanse, and one or more recirculating means for returning fluid from the collecting means to the distributor means. The recirculating means are power-operated fans or pumps, and may be individually servo-controlled.

24 Claims, 18 Drawing Figures

$$^{1}T_{1C} = T_S + \frac{\Delta T}{2}$$

$$^{2}T_{1C} = T_S + \frac{\Delta T}{3}$$

$$^{2}T_{2C} = T_S + \frac{2\Delta T}{3}$$

$$^{n}T_{iC} = T_S + \frac{i\Delta T}{(n+1)}$$

where $\Delta T = T_A - T_S$ n = number of paths i = path number (from interface)

METHOD AND APPARATUS FOR REDUCING THE RATE OF HEAT TRANSFER

CROSS-REFERENCE TO RELATED APPLICATION

This is a continuation-in-part of my copending U.S. patent application Ser. No. 928,866, which was filed on July 28, 1978 now U.S. Pat. No. 4,224,771.

BCKGROUND OF THE INVENTION

1. Field of the Invention

The present invention relates to methods and apparatus for reducing the rate of heat transfer across an interface forming a common boundary for a fluid body and another body so as to reduce unwanted heat loss or heat gain from one body to another. Some aspects of the present invention relate more particularly to reducing heat transfer through windows or panels separating fluid bodies of differing temperatures.

2. Description of the Prior Art

Previous attempts to control heat transfer between adjacent bodies have most often employed heat insulating materials. Thermal insulation has also been accomplished by double wall construction having a vacuum therebetween. Likewise, multiple walls have been used to define spaces for "dead" (confined) air and/or other gases, or to provide paths for circulating various fluids to absorb and carry over a portion of the heat.

In the case of windows where light transmissibility must be maintained, utilization of low thermal conductivity materials as heat insulation is effectively precluded. The heat conductivity of glass and other transparent materials most commonly used for windows is not particularly high, but the path length is usually quite short. Accordingly, reduction of heat transfer through windows is particularly desirable. However, light transmissibility and transparency requirements heretofore have necessitated use of multiple pane/dead air, vacuum or removable fluid construction. For instance, it has been proposed to provide a reversible window having double pane, dead air construction with a third pane spaced therefrom and passages for entry of air at the bottom, and exit of air at the top, of the third pane from the space between the double panes and the third pane (See U.S. Pat. No. 3,925,945). In winter, the third pane faces the interior of the building, and in summer it faces the exterior. In this construction, natural convection between the double pane and the third pane is intended to absorb heat energy and conduct it to the outside air in summer, or into the building in the winter.

A typical dual pane window having a vacuum therebetween is shown in U.S. Pat. No. 3,999,201, and a multi-pane window having provision for flushing out the dead air space to eliminate moisture and condensation therein is shown in U.S Pat. No. 3,932,971. A double pane window having water pumped through the space between the panes is shown in U.S. Pat. No. 4,024,726. A triple pane heat insulating window having a vacuum in one space between panes, and a forced flow of cooling fluid in the other space, is disclosed in U.S. Pat. No. 3,192,575. It therefore has been understood that unwanted heat transfer through windows can be reduced by adding more layers of glass at proper spacing, but this is quite expensive, especially for retrofit.

In winter, most of the heat passing through the window pane is lost to the air and this loss is greatly increased by natural convection. Air near the cold side of the window is heated by the glass, which reduced the density of such air, causing it to be forced upwardly by more dense air, which in turn approaches the pane, is heated, and the cycle repeats. Air near the warm side of a window is cooled and its density increases. The cool, dense air is pulled downwardly by gravity and warmer air replaces it. Again, this effect is repeated continually.

The flow of heat must be accounted for. When the outside air is cold and the inside air is warm, compensation for heat flow is accomplished by space heating. When the outside is warmer than the inside heat flow compensation is accomplished by air conditioning.

SUMMARY OF THE INVENTION

The present invention contemplates use of a relatively simple method and structure for reducing the unwanted flow of heat by collecting the air flowing upwardly or downwardly along the window as a result of the described natural convection, and distributing the collected air to the window to again flow along the window by natural convection. The air flow is collected in a trough at the top or bottom of the window, depending upon whether the convection flow is upwardly or downwardly on that side of the window, and is then drawn from the trough through a tube by a small fan for return to a distributor at the opposite edge of the window from the collector trough. Here the air is again discharged next to the window on the cold side and cooler than ambient air is returned to the window on the warm side. This reduces the temperature gradient across the window which in turn decreases the flow of heat. Some heat is still exchanged between the flowing air and the surrounding air, but this is less than the heat lost by unrestricted convection.

The invention is not restricted to air as the heat transfer (and absorbing) medium and recirculating fluid. It does, in fact, apply to any fluid in a force field, such as gravity, magnetism, electrical, centrifugal, centripetal, velocity changes, or otherwise to which the fluid is variably responsive in accordance with differences in temperature. Thus, the invention also applies to water tanks and to any other liquid or gas which is constrained at a boundary having an extent parallel to the lines of force.

The present application is also adapted for use with either one or both sides of a barrier interposed between two separate fluid bodies, and may be used on the fluid side of a barrier between a fluid and a vacuum.

The gravity responsive forms of the present invention are useful with vertical surfaces and with surfaces which are inclined between vertical and horizontal. For an inclined or vertical surface which is colder than the ambient adjacent fluid, the collector is positioned at the lower edge and the distributor is positioned at the upper edge. Conversely, if the inclined or vertical surface is warmer than the ambient temperature of the surrounding fluid, the collector is positioned at the higher edge and the distributor at the lower edge of the same surface. An inclined surface which is colder than the adjacent fluid should be tilted with its upper portions leaning away from the fluid so that the cooled, more dense liquid can run down the surface and not drop away from the surface, as would be the case if the upper edge of the surface were tilted toward the warmer fluid body. Likewise, where the fluid body is cooler than the surface, the upper edge of the surface should tilt toward the cooler body of flud so that fluid of lesser density (caused by receiving heat from the surface) will rise against the surface and not be dissipated into the surrounding fluid, as would be the case were the upper edge of the surface tilted away from the cooler fluid. Intentional inclination of the interface or heat loss surface can result in greater control of heat transfer than would be possible for a vertically extending interface. The invention applies not only to plane surfaces, but also to single curved surfaces, compound curved surfaces, and to faceted surfaces as well.

The present invention is most useful in situations where the convecting fluid is not transported away from the constraining surface or interface by a motion of the fluid stronger than the convection motion. For example, where a collector and distributor assembly is installed on the outside of a vertical building window, at times the wind may tend to blow away the convection boundary layer adjacent to the window pane, rendering the device less effective. However, a collector and distributor assembly installed on the inside of such window will remain effective. Inclining the window, even a few degrees from the vertical, can cause the convection boundary layer on the outside of the window to press more closely to the surface of the window pane and thus at least partially avoid the wind effect.

The transport of the fluid from the collector to the distributor is not limited to mechanical motion induced by a fan. Such transport can be induced as well by a small jet of the fluid or by other means, whether from pressure forces or body forces. "Body forces" are those forces which act throughout the fluid, such as gravity, while "pressure forces" act on an element of fluid with transfer of force by molecular forces.

It often is desirable to manifold several collectors and/or distributors to a common fan. This construction may be desirable in installations of some horizontal length, because the physical restriction of fluid flow in a conduit tend to limit the useful length of single collectors and/or distributors.

In accordance with another principal feature of my present invention, the rate of flow of the circulating fluid between the collector and the distributor of certain embodiments thereof is varied in accordance with the temperature of the fluid body containing the collector and the distributor and also in accordance with the temperature of the body interface at which the collector and distributor are located, whereby to minimize the heat transfer across said interface.

In accordance with a further principal feature of my present invention, certain embodiments thereof each comprise a plurality of collectors and a corresponding plurality of distributors, and a separate tube joins each collector with one of the distributors, thereby providing a multiplicity of fluid circulation parts, each of which includes a fluid pump.

In accordance with yet another principal feature of my present invention, the rate of flow of the circulating fluid in at least one of such a multiplicity of fluid circulation paths is controlled in accordance with the temperature of the fluid body containing the multiplicity of fluid circulation paths, and in accordance with the temperature of the body interface near which said fluid circulation paths are located, and also in accordance with the relative position of said at least one fluid circulation path with respect to said body interface, whereby to minimize the heat transfer across said interface.

It therefore is an object of the present invention to provide methods and apparatus for reducing the rate of heat transfer across an interface forming a common boundary for a fluid body and another body by collecting fluid displaced along an expanse of the interface in response to forces acting on the fluid body in the direction of the collection side of such expanse and discharging the collected fluid at the other side of the expanse; heat transfer through the interface increasing the effect of the described forces on the portion of the fluid body adjacent to the interface so as to displace the discharged collected fluid continuously across the expanse of interface for reducing the temperature gradient between the interface and the fluid body.

A further object of the present invention is to provide methods and apparatus of the character described wherein the interface is a common boundary between a fluid body and a solid body.

Another object of the present invention is to provide a method of reducing the rate of heat transfer from a heat loss surface to a fluid in contact therewith.

Another object of the present invention is to provide an apparatus of the character set forth in which the inerface, or the heat loss surface, is provided by a barrier of relatively thin sheet material bounding or confining a fluid body.

A further object of the present invention is to provide an apparatus of the character described in which the interface, or the heat loss surface, is provided by a barrier, in the form of a relatively thin sheet of thermally conductive material, separating fluid bodies, and wherein the fluid of at least one of the fluid bodies changes in density in response to changes in temperature, the forces acting on the fluid body tending to vary in effect in accordance with the amount of heat transmitted to or from such fluid through the interface.

A still further object of the present invention is to provide apparatus of the character described in which the aforementioned force acting on the fluid is gravity whereby less force is exerted on less dense fluid and more force is exerted on increased density fluid in accordance with heat transfer to or from the fluid across the interface.

Another object of the present invention is to provide an apparatus of the character described which is adapted for use on both sides of a window or panel so as to reduce heat transfer to the window or pane from one side, and to reduce heat transfer from the window or panel to the other side.

Yet another object of the present invention is to provide an apparatus of the character set forth which is capable of being moved from a position reducing heat transfer from the air inside a building to the outside air, and an inverted or reversed position reducing heat transfer from the outside air to the air inside the building.

A further object of the present invention is to provide a window structure for spacecraft and high altitude aircraft capable of reducing the rate of heat transfer from the air in the interior of the craft to the outside of the craft.

Another object of the present invention is to provide a window construction for a vessel such as a ship, boat, submarine or the like, which is capable of reducing the rate of heat transfer from the interior of the vessel to the surrounding liquid.

A further object of the present invention is to provide an apparatus of the character described which is capable of operation on a variety of configurations of heat loss surfaces and in a variety of inclinations from the horizontal, including the vertical.

A yet further object of my present invention is to provide apparatus of the character described in which the rate of flow of circulating fluid between the collector and the distributor is so controlled as to minimize the heat transfer across the body interface next to which the collector and the distributor are located.

An additional object of my present invention is to provide apparatus of the character described in which each embodiment comprises a plurality of collectors and a corresponding plurality of distributors, and a separate circulation tube joins each collector with one of the distributors, thereby providing an optimum multiplicity of fluid circulating paths, each of which includes a fluid pump.

A further object of my present invention is to provide apparatus of the character described in each embodiment of which the rate of flow of circulating fluid in at least one of a multiplicity of fluid circulation paths is controlled in accordance with the temperature of the fluid body containing the multiplicity of fluid circulation paths, and in accordance with the temperature of the body interface near which said fluid circulation paths are located, and also in accordance with the relative position of said at least one fluid circulation path with respect to said body interface, whereby to minimize the heat transfer across said body interface.

For a fuller understanding of the nature and objects of the present invention, reference should be had to the following detailed description and claims, taken in connection with the accompanying drawings.

While only the preferred forms of the invention have been illustrated in the accompanying drawings, it will be apparent that changes and modifications could be made thereto within the ambit of the invention as defined in the claims.

DETAILED DESCRIPTION OF THE PREFERRED EMBODIMENTS

The method of the present invention is adapted for reducing the rate of heat transfer across any interface forming a common boundary for a fluid body and another body, in which the fluid body is a liquid of gas constrained at the common boundary and acted upon by forces tending to move the fluid along an expanse of such interface, and wherein heat transfer through the interface either into the fluid body or away from the fluid body increases the effect of such forces on the portion of the fluid body adjacent to the interface so as to displace the layer of fluid adjacent the interface along such expanse. The displaced fluid is returned to the other side of such expanse to again pass over the expanse of interface.

In this manner, the recirculating layer of fluid adjacent to the interface will have a temperature between that of the body of fluid and the temperature on the other side of the interface. Usually, the fluid will vary in density according to temperature. Therefore, if heat is passing through the interface into the fluid body, the boundary layer of fluid at the interface will receive the heat and expand to a lower density. Conversely, heat passing through the interface from the fluid body will result in a layer of fluid at the interface which is denser than the rest of the fluid body.

The forces acting on the fluid may be described as "body forces" or "pressure forces". Body forces act throughout the fluid, such as gravity or inertial forces, while pressure forces act on an element of fluid with transfer of force by molecular forces. Thus, gravitational forces will have a tendency to cause heated, less dense fluid to rise with respect to the body of fluid, while cooled, denser fluid will tend to sink.

Figure 1:
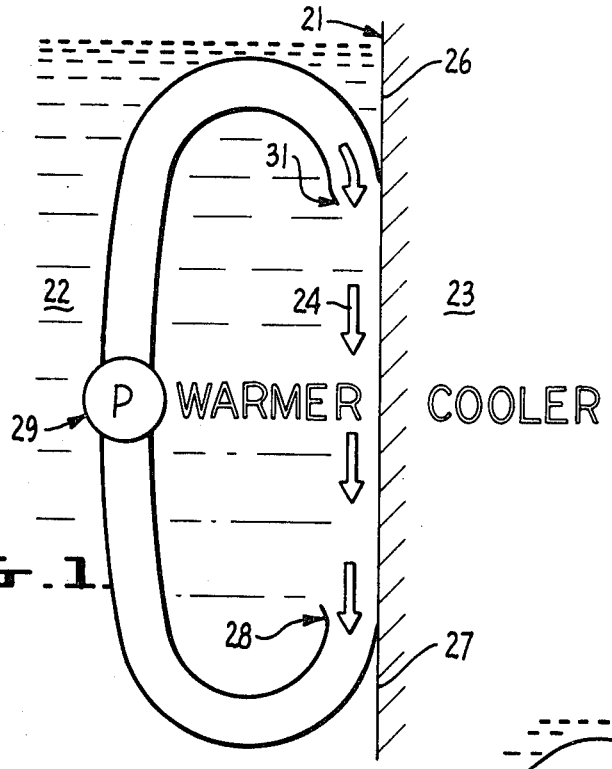
FIG. 1 is a diagrammatic cross-sectional view of an interface forming a common boundary for a fluid body and another body illustrating fluid flow paths according to the present invention, the interface being shown in a vertical position.

FIG. 1 of the drawings schematically depicts a vertically extending interface 21 forming a common boundary between a warmer fluid body 22 and a cooler solid body 23. Arrows 24 indicate the flow path of fluid cooled by heat transfer away from fluid 22 through the interface 21. In this illustration, gravity causes the cooled layer of fluid adjacent interface 21 to sink from the upper edge 26 to the lower edge 27 of an expanse of interface 21. At 27, the sinking cooled fluid is intercepted and collected by collector means 28 and is returned as by pump means 29 to a distributor means 31 located at the upper edge 26 of the described expanse of interface.

As the cooled fluid recirculates along the path indicated by arrows 24, the temperature gradient across the interface is reduced, resulting in less flow of heat energy from the fluid body 22. Some heat energy is still exchanged between the downwardly flowing fluid and the surrounding fluid, but this is less than the heat lost by unrestricted convection. Were the sinking, cooled fluid not collected and recirculated in the manner described, it would merely sink to the bottom of the body of fluid and the temperature gradient across the interface would continue to be the differential between the average fluid temperature and the average temperature of the other side of the interface.

Where the body of fluid 22 is cooler than the solid body 23, the positions of the collector means 28 and distributor means 31 are reversed. The layer of fluid adjacent to interface 21 is heated and made less dense by heat energy transferred across interface 21 from solid body 23. Convection forces cause the layer of heated, less dense fluid to rise along interface 21, reducing the temperature gradient and consequently reducing heat transfer across the interface.

The described principle applies also to interfaces which are not parallel to the lines of force, but which are positioned in such manner that the boundary layer of heated or cooled fluid adjacent to the interface will move across an expanse of the interface under the influence of such forces. Thus, where gravity is the force acting on the fluid, the interface may be inclined from the vertical in the manner suggested in FIGS. 2 and 3 of the drawings.

Figure 2:
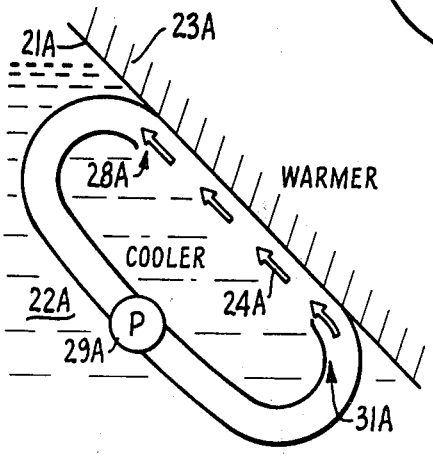
FIG. 2 is a diagrammatic cross-sectional view similar to that of FIG. 1, but illustrating an inclined interface between a warmer solid body and a cooler liquid body.

FIG. 2 illustrates a typical orientation of an interface 21A between a cooler fluid body 22A and a warmer solid body 23A. The inclination may vary from the horizontal to the vertical, but the interface 21A should be tilted at the top in the direction of the cooler body of fluid 22A so that the boundary layer of less dense, heated fluid will follow the path indicated by arrows 24A, rising against the inclined interface 21A to be collected at 28A and returned via pump means 29A for distribution at 31A at the lower edge of the desired expanse of the interface. If interface 23A were tilted at the top away from the cooler body of fluid, the heated, less dense fluid would tend to rise away therefrom the interface, thus losing the described heat transfer reducing effect of the present invention.

Figure 3:
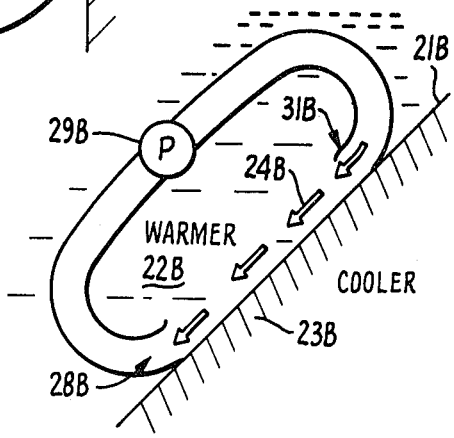
FIG. 3 is a diagrammatic cross-sectional view similar to those of FIGS. 1 and 2, but illustrating an inclined interface between a cooler solid body and a warmer liquid body.

FIG. 3 illustrates a typical inclined interface 21B between a warmer fluid body 22B and a cooler solid body 23B. In this situation, the upper portion of the interface 21B is tilted away from the warmer fluid body 22B so that the boundary layer of cooled, denser fluid will follow the path illustrated by arrows 24B downwardly along the desired expanse of interface 21B. The downwardly moving cooled, denser fluid is collected at 28B and returned via pump means 29B to be distributed at 31B back onto the upper edge of the desired expanse of interface 21B. Were the upper portion of interface 21B to be tilted in the direction of the warmer body of fluid 22B, the cooled, denser fluid would tend to drop vertically away from the interface and not accomplish the reducing effect on heat transfer provided by the present invention.

Figure 4:
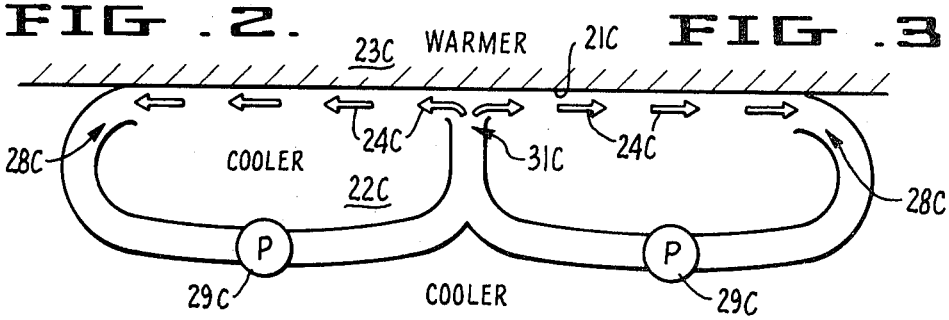
FIG. 4 is a diagrammatic cross-sectional view illustrating a horizontal interface between a solid and a liquid under the influence of forces other than gravity.

The heat transfer reducing principle of the present invention can also be used with horizontal surfaces. As depicted schematically in FIG. 4 of the drawings, the boundary layer of fluid at a horizontally extending interface 21C, between a warmer solid body 23C and a subjacent cooler fluid body 22C, will become heated and accordingly less dense than the average density of the body of fluid. Forces acting in the direction of arrows 24C to urge the heated layer of fluid along the interface 21C create the desired movement of the heated fluid across the interface. The heated fluid is intercepted at 28C and returned via pump means 29C to be distributed back onto the interface at 31C.

Where the fluid body 22C is warmer than the solid body 23C, the positions shown in FIG. 4 will be reversed with the fluid body 22C above and the solid body 23C below the interface 21C.

As will be apparent, the forces acting on the fluid layer subject to warming or cooling because of heat transfer across the interface may be forces other than gravity, so long as these forces act on the body of fluid in the desired direction and with the described varying effect in accordance with the temperature of the fluid.

The present invention is particularly valuable in reducing heat transfer from one fluid body to another fluid body through a solid barrier of thermally conductive materia. This is especially true where the fluid of at least one of the fluid bodies changes in density in response to localized changes in temperature, that is, the boundary layer of fluid at the barrier becomes more or less dense than the surrounding fluid in accordance with heat transfer through the barrier away from or into the boundary layer of fluid. Many forces, particularly gravitational and inertial forces, exert more effect on denser fluid and less effect on less dense fluid.

Where gravitational forces are involved, the denser fluid tends to sink through the fluid body and the less dense fluid tends to rise, this process being known as "convection." These natural convection forces are utilized to move the boundary layer of fluid upwardly or downwardly along the barrier, and the moving layer of fluid is collected and again discharged against the barrier for repeated upward or downward movement therealong. In this manner, a layer of fluid is continually provided at the barrier which has absorbed or given up heat energy across the barrier and is nearer the temperature on the other side of the barrier than is the main body of fluid.

The barrier between the adjacent fluid bodies will normally comprise a relatively thin sheet of thermally conductive material prone to transfer heat energy from the warmer body to the cooler body. Accordingly, the barrier may be formed of metal, plastics, or other materials, including glass and may be in the form of a panel, wall structure or window through a wall structure.

Figure 5:
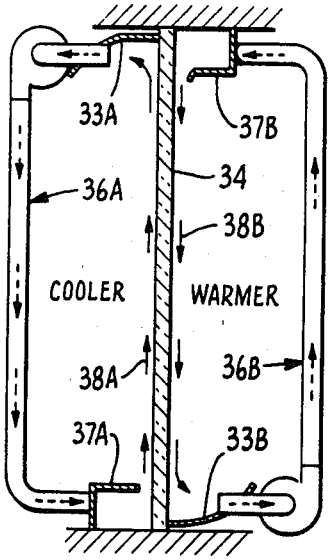
FIG. 5 is a vertical cross-sectional view of a window or panel having heat transfer reducing means constructed in accordance with the present invention and illustrated in simplified, schematic depiction.

A typical installation for controlling heat transfer through a window pane is illustrated in FIG. 5 of the drawings. As there shown, a downwardly opening collector trough 33A is mounted near the top of the cooler side of a window pane 34, and an upwardly opening collector trough 33B is mounted near the bottom of the opposite, warmer side of pane 34. Recirculating means 36A draws air from the trough 33A and supplies such air to distributor 37A located near the bottom of the same, cooler, side of window 34. Likewise, recirculating means 36B draws air from collector trough 33B and supplies such air to a distributor 37B positioned near the top of the same, warmer, side of window pane 34. Collector 33A is thus positioned on the cooler side of pane 34 in position to receive the boundary layer of air on that side, adjacent to pane 34. This boundary layer of air becomes less dense by heat transfer through pane 34 from the warmer side, and the less dense air rises along pane 34 in the path indicated by arrows 38A.

On the warmer side of the window, collector trough 33B is positioned to receive the downwardly flowing boundary layer of air adjacent to pane 34, which moves downwardly along path 38B by reason of increased density caused by heat transfer from such layer through pane 34 to the cooler side of the window.

Figure 6:
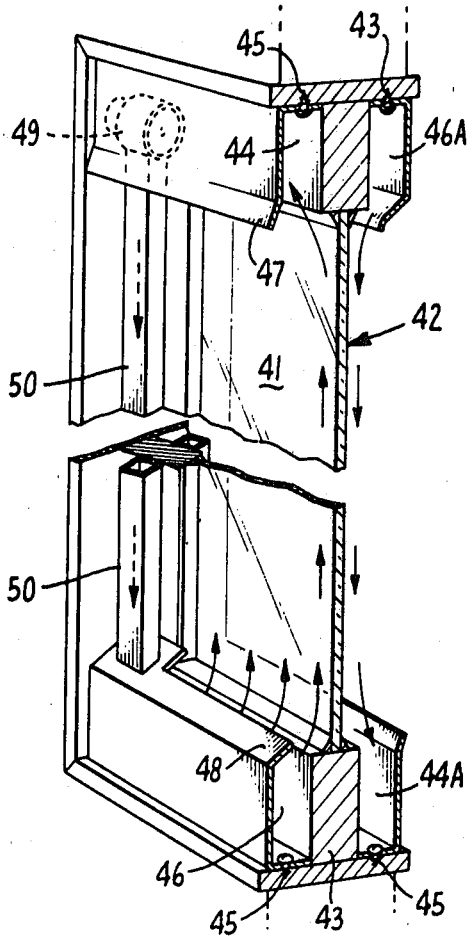
FIG. 6 is a perspective view of a window structure, in accordance with the present invention, with portions being broken away and shown in section to reveal internal construction.

The apparatus of the present invention is well adapted for relatively inexpensive retrofit to existing window structures. As illustrated in FIG. 6 of the drawings, an existing window structure 41 having a pane 42 mounted in a sash 43 is provided with apparatus constructed in accordance with the present invention. As there shown, a collecting trough 44 is mounted against and utilizes one face of the upper run of sash 43, while a distributor 46 is mounted adjacent and utilizes one face of the lower run of sash 43.

Preferably, the outer lip 47 of trough 44 is flared outwardly as shown to funnel the upwardly moving layer of air into the trough, and the distributor 46 is provided with an inturned lip 48 for discharging the collected air against pane 42. The collected air is moved from trough 44 by a motor driven fan through conduit 50 to the distributor 46. A collector trough 44A, similar to collector trough 44, is mounted along the lower run of sash 43, and a distributor 46A, similar to distributor 46, but inverted, is mounted along the upper run of sash 43. The downwardly moving layer of air collected in trough 44A is pumped upwardly toward distributor 46A by a motor driven fan and conduit (not shown) similar to fan 49 and conduit 50, but inverted.

Figure 7:
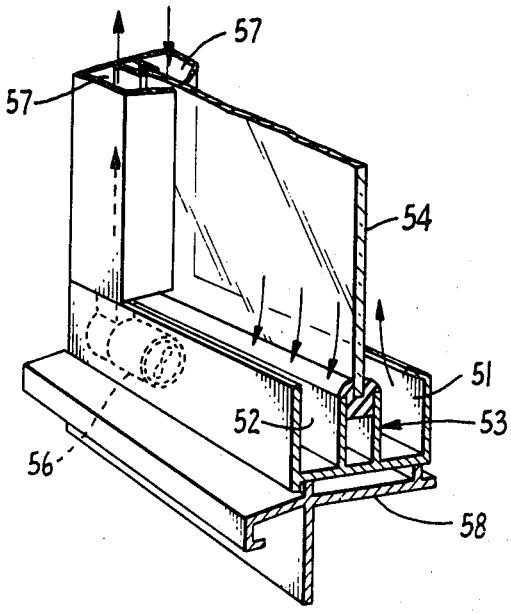
FIG. 7 is a view similar to the lower portion of FIG. 6, but illustrating a modified form of the invention.

The apparatus of the present invention is also well suited for original installations. A modified form of the invention for use in original installations is illustrated in FIG. 7 of the drawings, representing the corner portion of a window structure. Here, a distributor trough 51 and collector trough 52 are provided by a single extrusion member 53, which also provides a sash for mounting of a windowpane 54. A motor driven fan assembly 56, or the like, is concealed in collector trough 52 and supplies air therefrom through a conduit 57 to the associated distributor (not shown) on the same side.

In FIG. 6 of the drawings, the cooler air is on the same side of pane 42 as is collector 44, and the warmer air is assumed to be on the opposite side. Assuming the cooler air is inside and the warmer air is outside, as would normally be the case in the summertime when air conditioning is used the relative positions of the collector through 44 and distributor 46 must necessarily be reversed in the wintertime when the heated air is inside and the colder air is outside. In the form of the invention illustrated in FIG. 6 of the drawings, the collector troughs and distributors are removably secured in place, as by screws 45, so that the unit may be removed from its position against the window and either inverted, or moved to the other side of the window.

In the form of the invention shown in FIG. 7 of the drawings, the entire window and sash assembly, providing the collector and distributor, may be bodily removed from its opening in the frame 58 and either inverted or rotated 180° about a vertical axis and reinserted into the opening.

Where the horizontal extent of the window is rather long, as in the case of plate glass display windows and picture windows, several units may be manifolded together to be operated from a single fan. This eliminates problems caused by the physical restrictions of fluid flow in a conduit or trough, which would otherwise limit the useful length of single collectors and/or distributors.

Figure 8:
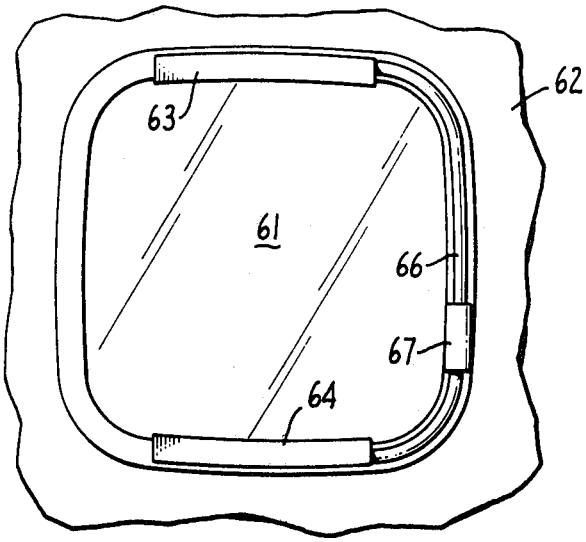
FIG. 8 is a front elevational view of a window constructed in accordance with the present invention.
Figure 9:
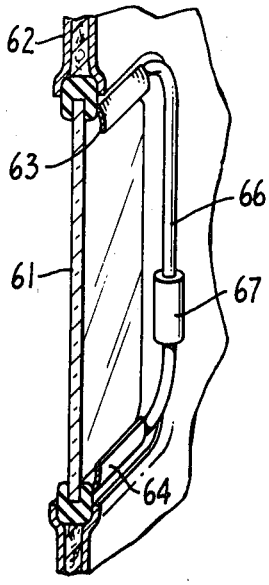
FIG. 9 is a perspective view of the window of FIG. 8, with portions being broken away and shown in section to reveal internal construction.

The apparatus of the present invention also is particularly useful for reducing heat transfer through the windows of various types of transport craft such as submarines, ships, boats, land vehicles, aircraft and space craft. A typical window construction for such transport craft is illustrated in FIGS. 8 and 9 of the drawings. As there shown, the windowpane 61 is mounted in an insulated wall structure 62. However, it should be apparent that the walls also could be without substantial installation, and apparatus according to the present invention could be applied to desired expanses of such walls.

As illustrated in FIGS. 8 and 9, a distributor 63 is mounted along the upper edge of pane 61, and a collector trough 64 is mounted along the lower edge to receive the boundary layer of air passing downwardly along pane 61 by natural convection caused by heat loss from the boundary layer through pane 61 to the exterior of the craft. The collected cooled, denser air is recirculated from collector trough 64 to distributor 63 through a conduit 66 in which is interposed a suitable fan or air pump 67.

In those instances wherein the interior of the craft is to be maintained at a cooler temperature than the exterior, as in desert vehicles, the unit is inverted so that distributor 63 runs along the bottom edge of the window and collector trough 64 along the upper edge.

As illustrated in FIGS. 5 through 9 of the drawings, the windowpane extends substantially vertically. In certain situations, the convecting fluid may tend to be transported away from the constraining surface by a stronger fluid motion. For example, if a collector and distributor assembly were installed on the outside of the building window, at times the wind would render it less effective, even though a symmetric (inverted) unit installed on the inside would remain effective.

In these situations, where wind or other fluid motion tends to strip the boundary convection layer away from the surface, greater control of heat transfer through such surface can be obtained by intentional inclination of such surface. As described in connection with FIGS. 2 and 3 of the drawings, the upper edge of the inclined surface must necessarily be tilted in the direction of the cooler body of fluid so that the warmed layer of fluid will tend to rise against the surface and the cooled boundary layer of fluid will tend to sink against the surface.

Figure 10:
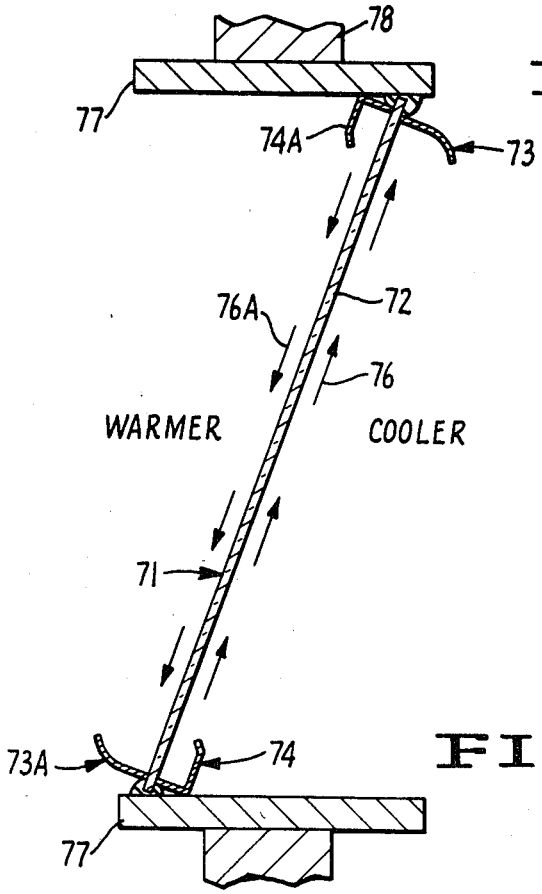
FIG. 10 is a vertical cross-sectional view of an inclined window structure constructed in accordance with the present invention.

A typical installation for a building window, taking advantage of the described advantages of intentionally inclining the heat transfer surfaces, is illustrated in FIG. 10 of the drawings. As there shown, the window assembly 71 has an inclined windowpane 72, with a collector trough 73 at the upper edge of the pane 72 on the cooler side, and a distributor trough 74 extending along the lower edge of pane 72, also on the cooler side. On the warmer side, the collector trough 73A is mounted along the lower edge of pane 72 and the distributor 74A is mounted along the upper edge.

The structure of FIG. 10 is also adapted for conversion when the relative temperatures of the bodies of air it separates are reversed. For this purpose, pane 72 is mounted in a frame 77 which is formed for removal from an opening in wall 78 and for reinsertion into such opening after the unit has been rotated 180° around a vertical axis.

Figure 11:
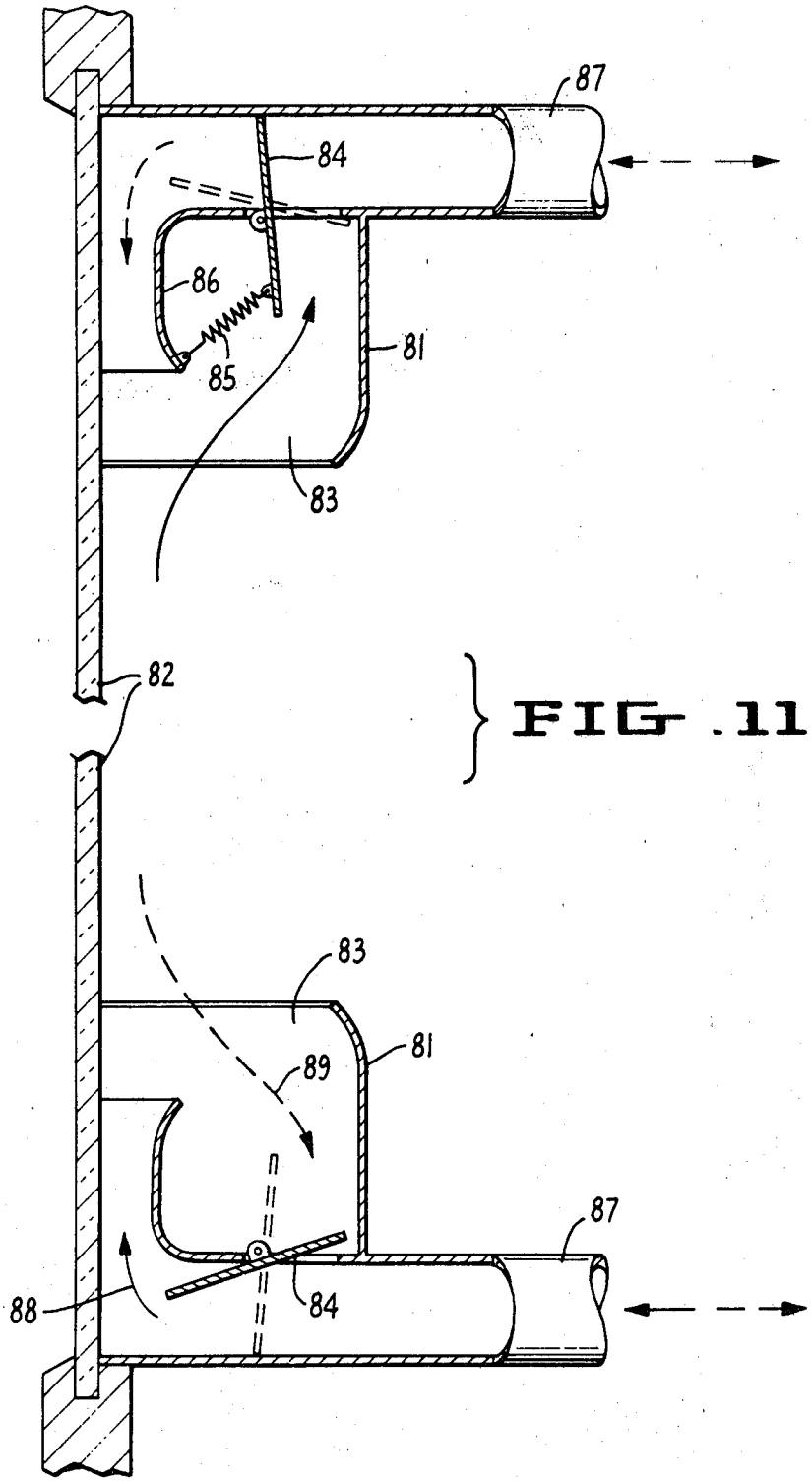
FIG. 11 is a fragmentary vertical cross-sectional view of a modified form of the invention showing a combination collector-distributor structure.

A modified form of the invention is illustrated in FIG. 11 of the drawings in which the same structure is permanently mounted in place and automatically adapts itself to act either as a collector trough or as a distributor. For this purpose, a generally vertically extending wall 81 is mounted in spaced relation to a windowpane 82 along the lower edge thereof to define a trough 83. Pivotally mounted to extend along trough 83 is a flap valve 84, to which is attached a longitudinally extending, upwardly curving member 86. A conduit 87 communicates with trough 83 for alternatively supplying air and removing air.

When in the distributor mode, with air being supplied to trough 83 through conduit 87, the force of such air swings valve member 84 and associated member 86 to the position illustrated in full lines in FIG. 11. In this position, the air is forced through a comparatively narrow slot between member 86 and windowpane 82 to assist in limiting the thickness of the convection boundary layer.

When in the collecting mode, with the collected air being removed from trough 83 through conduit 87, either gravity or a spring 85 moves the valve member 84 to the position shown in dotted lines in FIG. 11 of the drawings. In this position, the collected air is free to flow down to the bottom of trough 83 for removal through conduit 87.

A similar dual purpose collector-distributor with flow activated valve can be utilized at the top of the window and functions automatically in a similar manner. With such an installation at both the top and bottom of the window, connected by a recirculating means (not shown), it is only necessary to reverse the direction of air flow through the conduits 87 in order to convert the device from collector to distributor and vice versa.

Figure 12:
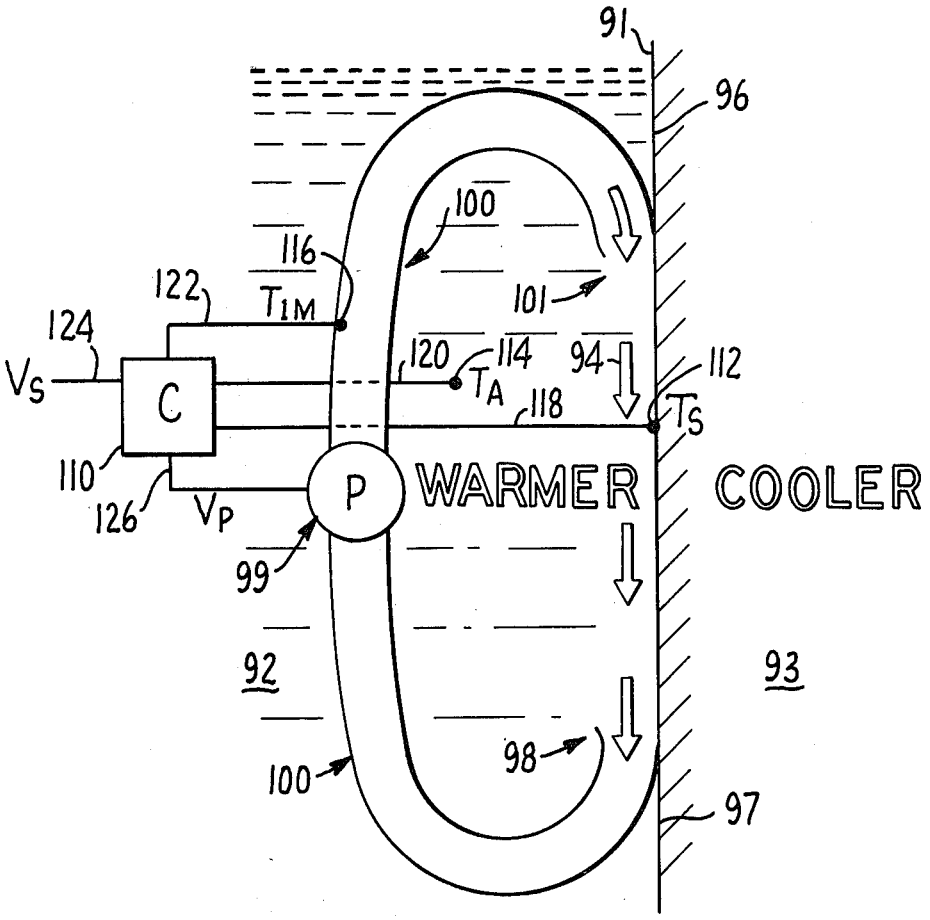
FIG.12 is a diagrammatic cross-sectional view of an interface forming a common boundary for a fluid body and another body, illustrating fluid flow paths typical of my present invention, and further illustrating control means embodying my invention for controlling the rate of flow of fluid past said interface in accordance with the temperature of the fluid body and also in accordance with the temperature of the interface.

FIG. 12 of the drawings schematically depicts a substantially vertically extending interface 91 forming a common boundary between a relatively warm fluid body 92 and a relatively cool solid body 93. Arrows 94 indicate the flow path of fluid cooled by heat transfer away from fluid 92 through the interface 91. In this illustration, gravity causes the cooled layer of fluid adjacent interface 91 to sink from the upper edge 96 to the lower edge 97 of an expanse of interface 91. At 97, the sinking cooled fluid is intercepted and collected by collector means 98 and is returned as by pump means 99 to a distributor means 101 located at the upper edge 96 of the described expanse of interface.

As the cooled fluid recirculates along the path indicated by the arrows 94, the temperature gradient across the interface is reduced, resulting in less flow of heat energy from the fluid body 92. Some heat energy is still exchanged between the downwardly flowing fluid and the surrounding fluid, but this is less than the heat lost by unrestricted convection. Were the sinking, cooled fluid not collected and recirculated in the manner just described, it would merely sink to the bottom of the body of fluid, and the temperature gradient across the interface would continue to be the differential between the average fluid temperature and the average temperature of the other side of the interface.

As pointed out hereinabove, where the body of fluid 92 is cooler than the solid body 93, the positions of the collector means 98 and the distributor means 101 will be reversed, in accordance with the principles of my invention. In that case, the layer of fluid adjacent to interface 91 is heated and made less dense by heat energy transferred across interface 91 from solid body 93. In accordance with my invention, the recirculated layer of heated, less dense fluid passing along interface 91 reduces the temperature gradient and consequently reduces heat transfer across the interface.

As also pointed out hereinabove, this just described principle applies also to interfaces which are not parallel to the lines of gravitational force, but which are positioned in such manner that the boundary layer of heated or cooled fluid adjacent to the interface will move across an expanse of the interface under the influence of such forces. Thus, with respect to the apparatus and methods of FIGS. 12 through 14, where gravity is the force acting on the fluid, the interface may be inclined from the vertical in the manner suggested in FIGS. 2 and 3 of the present drawings.

Returning now to FIG. 12, it will be seen that the apparatus of my invention shown therein further comprises pump control means 110. In accordance with certain principles of my invention, pump control means 110 (which is shown in detail in FIG. 12A) is so constructed and arranged as to determine the speed of operation of pump 99, and thus determine the rate of flow of fluid therethrough, and the temperature of the air fluid passing therethrough in accordance with the formula of FIG. 13A, which formula represents a particular aspect of a principle of my invention which I call the "optimum flow rate principle". It is to be understood that the optimum flow rate principle of my invention is not limited to application in embodiments of my invention of the kind shown and described in FIG. 12, but rather, as described in detail hereinafter, also has application in embodiments of my invention which also embody another principle of my invention which I call the "multiple circulation path principle". (Cf., e.g., FIGS. 13B, 13C, and 14 of the present drawings.)

Returning now to FIG. 12, it will be seen that in addition to the pump control means C, designated by the reference numeral 110, the embodiment of my invention shown in FIG. 12 also comprises a temperature sensor 112 which is adapted to sense the temperature $T_S$ of interface 91, and a temperature sensor 114 which is adapted to sense the ambient temperature $T_A$ of the body of fluid 92.

In addition, the apparatus of my invention shown in FIG. 12 further comprises a temperature sensor 116 which is adapted to sense the temperature $T_{1M}$ of the circulating fluid passing from pump 99 to distributor 101 through tube 100.

As also seen in FIG. 12, a signal line 118 is provided, extending from temperature sensor 112 to pump control means 110, to convey to pump control means 110 signals representative of the temperature $T_S$ sensed by temperature sensor 112.

Similarly, a signal line 120 is provided, extending from temperature sensor 114 to pump control means 110, to convey to pump control means 110 signals representative of the temperature $T_A$ sensed by temperature sensor 114; and a signal line 122 is provided, extending from temperature sensor 116 to pump control means 110, to convey to pump control means 110 signals representative of the temperature $T_{1M}$ sensed by temperature sensor 116.

As further seen in FIG. 12, pump control means 110 is provided with operating power by way of a power supply line 124, which in the particular electrical embodiment of my present invention shown in FIG. 12 is maintained at a supply voltage $V_S$.

As yet further shown in FIG. 12, pump control means 110 is provided with an output lead 126, which carries to pump 99 a pump operating voltage $V_P$. As will be explained hereinafter in connection with FIG. 12A, pump control means 110 serves to vary pump operating voltage $V_P$, and thus the speed of pump 99, and the circulating fluid temperature, in accordance with the formula of FIG. 13A, which embodies a principle of my invention.

Figures 13A, 13B, 13C, 13D, 14:
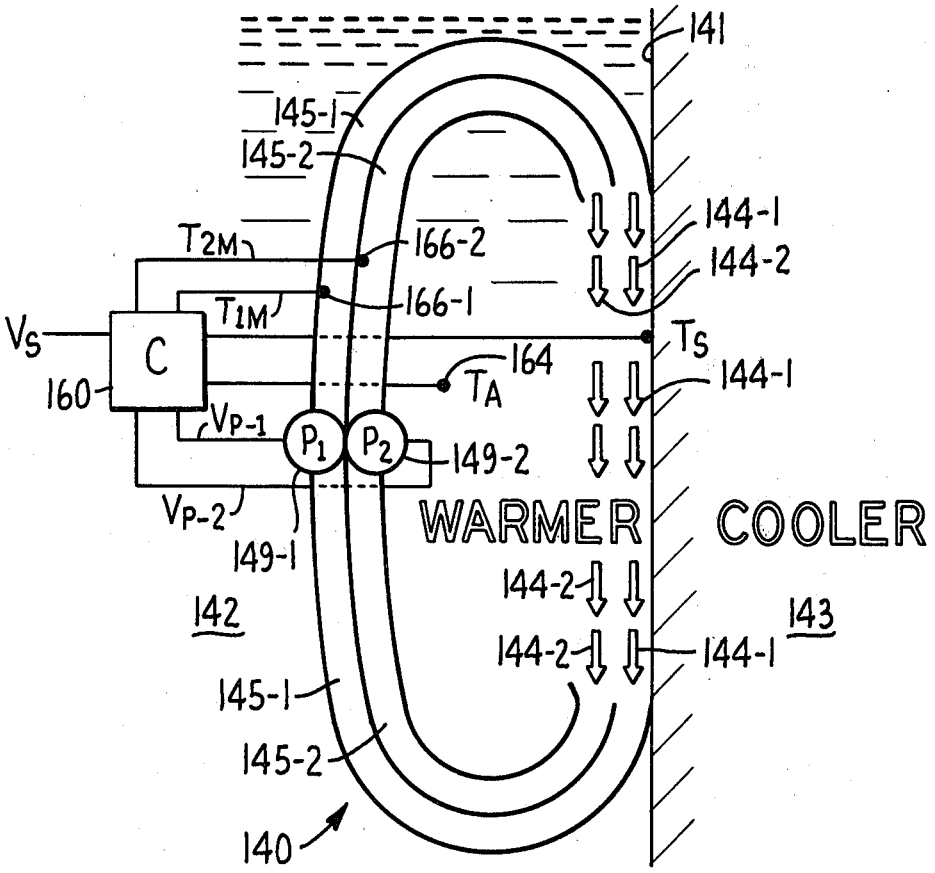
FIGS. 13A through 13C represent the relationship between the temperature of the fluid body, the temperature of the interface, and the temperature of the circulating fluid in the circulation tube or tubes of certain embodiments of my present invention.
FIG. 13D represents the general relationship between the temperature of the fluid body, the temperature of the interface, and the temperature of the circulating fluid in the circulation tube or tubes in any embodiment of a class of preferred embodiments of my present invention.
FIG. 14 is a diagrammatic cross-sectional view of an interface forming a common boundary for a fluid body and another body, illustrating fluid flow paths according to a multiple fluid flow path embodiment of my present invention, and further illustrating control means embodying my invention for controlling the rate of flow of fluid in said multiple fluid flow paths past said interface in accordance with the temperature of said fluid body; and in accordance with the temperature of said interface, and also in accordance with the relative positions of said fluid flow paths with respect to said interface.

Referring now to the equation of FIG. 13A, it will be seen that the variable $T_S$ on the righthand side of that equation is the temperature $T_S$ sensed by temperature sensor 112 of FIG. 12. As pointed out in FIG. 13D, the temperature differential $\Delta T$ is the temperature $T_A$ sensed by sensor 114 of FIG. 12 less the temperature $T_S$ sensed by sensor 112.

Going to the lefthand side of the equation of FIG. 13A, it is to be understood that the preceding supercript "1" denotes the fact that there is only one circulation path in the corresponding structure, e.g., the structure of FIG. 12. Since there is but one circulation path in the corresponding structure, subscript "1C" on the lefthand side of the equation of FIG. 13A refers to that one and only circulation path. (By contrast, embodiments of my invention having two circulation paths will be represented by a pair of equations, the equations of FIGS. 13B and 13C, and in that case the preceding superscripts will both be "2", and the following subscripts on the lefthand sides of the two equations will be "1C" and "2C", respectively, to distinguish between the two circulation paths of the corresponding structures.) (The further generalization of my invention to devices having more than two circulation paths will follow the general equation of FIG. 13D.) (An embodiment of a two circulation path device according to my invention is shown in FIG. 14, and described hereinbelow in connection therewith.)

Figure 12A:
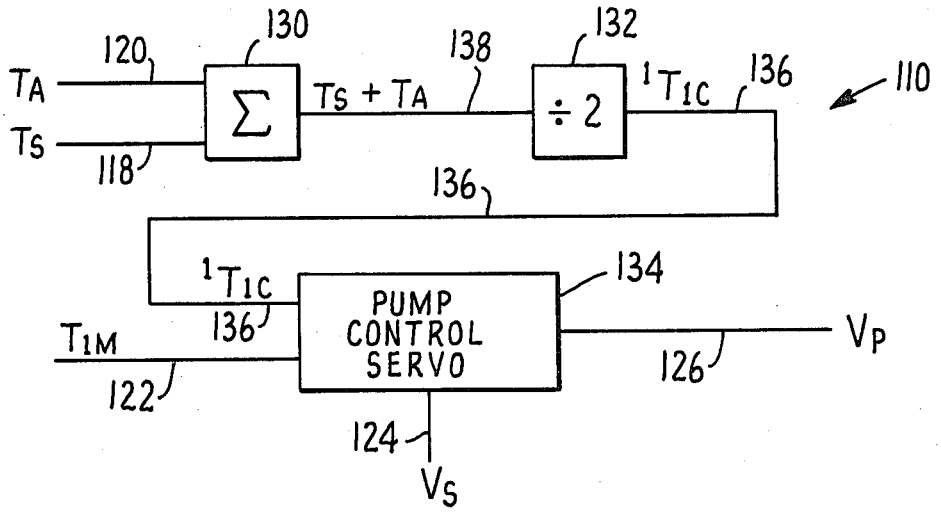
FIG. 12A is schematic representation of the control means of FIG. 12.

Before considering FIG. 12A in detail, it should be noted that, as will be evident to those having ordinary skill in the art, the righthand side of the equation of FIG. 13A can be replaced by half the sum of $T_S$ and $T_A$, which expression is more convenient in reaching an understanding of the operation of pump control means 110, as shown in FIG. 12A.

Referring now to FIG. 12A, it will be seen that pump control means 110 comprises an electrical summing device 130 and an electrical device 132 adapted for dividing its input signal by a constant, viz., 2.

Electrical summing device 130 may be any one of many different analog summing devices well known to those having ordinary skill in the art, the selection and adaptation of which is within the scope of anyone having ordinary skill in the analog computation art informed by the present disclosure. It is to understood, however, that not all embodiments of my invention will necessarily operate on analog principles. As an example only, analog summer 130 may be a well known Kirchhoff adder, provided in the well known manner, if necessary, with suitable solid state operational amplifying means to stabilize its operation.

Similarly, constant divider 132 may be one of many different analog devices well known to those having ordinary skill in the art for serving that function, e.g., a resistor network, the selection and adaptation of which is within the scope of those having ordinary skill in the analog computation art, informed by the present disclosure.

Referring again to FIG. 12A, it will be seen that pump control means 110 further comprises a pump control servomechanism 134; the selection from the prior art and adaptation of such a servomechanism being well within the scope of one having ordinary skill in the art, informed by the present disclosure.

The function of pump control servo 134 is to provide at all times such a pump operating voltage $V_P$ on line 126 that the rate of circulation in circulation path 98-100-101 is such that the temperature $T_{1M}$ tends to remain equal to the temperature ${}^1T_{1C}$ (cf., FIG. 13A) at all times.

Since an increase of pump speed in FIG. 12 will increase the temperature of the circulating fluid, toward the temperature of the body of fluid 92, and a decrease of pump speed in FIG. 12 will decrease the temperature of the circulating fluid, toward the temperature of the interface, it follows that pump servo 134 will be designed, within the scope of those having ordinary skill in the art as informed by the present disclosure, to decrease the speed of pump 99 when temperature $T_{1M}$ exceeds temperature ${}^1T_{1C}$, i.e., when the signal on line 122 exceeds the signal on line 136; and vice versa.

Referring again to FIG. 12A, it will now be understood that summing device 130 serves to constantly provide on signal line 138 a voltage proportional to the sum of the temperatures $T_A$ and $T_S$. It will also be understood that constant divider 132 at all times divides the voltage on signal line 138 by the constant 2, and thus at all times produces on signal line 136 a voltage proportional to the variable ${}^1T_{1C}$ of the equation of FIG. 13A, the constant of proportionality being the same as the constant of proportionality affecting the signal on signal line 138. (As will be evident to those having ordinarly skill in the art, the signal on signal line 122 is affected by the same constant of proportionality, and thus the signals on lines 136 and 122 correspondingly represent the computed desired circulating fluid temperature ${}^1T_{1C}$ and the actual circulating fluid temperature $T_{1M}$, respectively.)

In view of the above, it will now be seen by those having ordinary skill in the art that pump control means 110 FIG. 12 tends at all times to maintain the temperature of the fluid circulating in circulation path 98-100-101 equal to the ideal, i.e., minimum heat loss, temperature computed from the equation of FIG. 13A.

Referring now to FIG. 14, it will be seen by those having ordinary skill in the art, informed by the present disclosure, that the heat transfer rate reducing apparatus 140 of my invention shown therein is of the two-circulation-path type contemplated in the equations of FIGS. 13B and 13C.

As will be evident from the preceding disclosure, there is shown in FIG. 14 an interface 141 between a warmer fluid body 142 and a cooler solid body 143. A first circulation path 144-1 (indicated by arrows 144-1) lies nearer to interface 141 than a second circulation path 144-2 (indicated by arrows 144-2). Circulation path 144-1 extends through circulation tube 145-1, and circulation path 144-2 extends through circulation tube 145-2. Circulation in circulation tube 145-1 is produced by fan or pump 149-1, and circulation in circulation tube 145-2 is produced by fan or pump 149-2.

Further, the operating speeds of pumps 149-1 and 149-2 are controlled by pump control means 160.

The ambient temperature $T_A$ of the fluid body 142 is sensed by sensor 164, and the temperatures of the circulating fluids in tubes 145-1 and 145-2 are sensed by temperature sensors 166-1 and 166-2, respectively.

The provision of suitable pump control means, including suitable pump control servo means, for controlling the temperatures of the circulating fluids in tubes 145-1 and 145-2 so that they remain at all times substantially equal to the desired circulation fluid temperatures ${}^2T_{1C}$ and ${}^2T_{2C}$ defined by the equations of FIGS. 13B and 13C, respectively, is within the scope of those having ordinary skill in the art, informed by the present disclosure.

Further, the provision of heat transfer rate reducing systems embodying the aspects of my invention taught generally in the equation of FIG. 13D will now also be seen to be within the scope of those having ordinary skill in the art, informed by the present disclosure.

It will also be understood by those having ordinary skill in the art, informed by the present disclosure, that in carrying out my invention the rate of flow in the respective circulating paths can be controlled by throttling flows produced by constant speed fans or pumps, rather than by controlling the speeds of the respective fans or pumps.

In addition, it is to be understood that the employment of high-voltage electrofluidynamic pumps or fans of the type invented and devised by Thomas Townsend Brown and others in lieu of rotary pumps in devices of the kind shown and described herein is a particular feature of my invention.

It is also contemplated as part of my invention that for flow control with a throttling device in carrying out my invention the cooperating temperature sensing means may be bimetallic devices, Bourdon tubes, aneroid bellows, or the like, rather than electrical devices.

It is also to be understood that in accordance with certain principles of my invention it may be desirable in devices of my invention having a plurality of circulation paths to servo-control the rate of flow in only one circulation path, and to maintain the rates of flow in the other circulation paths proportional to the rate of flow in the servo-controlled path, the proportionality between the rate of flow in the servo-controlled path and the rate of flow in any other path beig determined in accordance with the factors $i/(n+1)$ of the respective pairs of flow paths.

It is further contemplated as part of my invention that in certain embodiments thereof the circulation path or paths may be directed in directions other than that of the gravitational attraction, e.g., from side to side of a window, rather than from top to bottom thereof.

It is yet further contemplated as part of my invention that in order to reduce the counter-effects of room air currents or outside wind it may be desirable to locate vertical guides on the interface and/or at the sides thereof. An ideal guide can reduce the wind energy by both springiness and perviousness. An example of a good guide for this use as found in nature is the presence of trees, which absorb the energy of gusts by resilient or spring action, and which also provide a viscous damping effect due to their leaves and twigs. In the practice of my invention, then, it is contemplated to make use of, e.g., a tapered shape of open work material, such as rubberized hair or plastic foam. Alternatively, such guides may be "T" or "C" shaped, and be provided with holes in their stem portions. These guides may, for example, be as small as, say, one quarter inch by two to five inches, and thus not be visually obtrusive, and may be disposed about windows, especially if they are disposed around the edges thereof, say, two or three feet apart.

In view of the foregoing, it will be seen that the method and apparatus of the present invention provides a novel way of reducing the transfer of heat across an interface between a fluid body and an adjacent body. The method and apparatus of the present invention are particularly suited for controlling unwanted heat loss from the interior of a structure and unwanted heat acquisition into the interior of the structure, the invention having particular reference to heat control through high conductivity windows, panels, and the like.

What I claim is:

1. Apparatus for reducing the rate of heat transfer from a constrained heat loss surface to a fluid in contact therewith, comprising:

a collector mounted adjacent to the heat loss surface and formed for intercepting fluid displaced along said surface by forces acting in the direction of said collector in accordance with heat loss from said surface into said fluid;

a distributor mounted adjacent to said heat loss surface in spaced relation to said collector and formed for discharging fluid for displacement along said surface to said collector;

recirculating means formed for removing fluid from said collector and supplying such fluid to said distributor; and recirculation rate control means for so controlling the rate at which said recirculating means removes said fluid from said collector and supplies it to said distributor that the temperature of the recirculating fluid tends to approach a temperature intermediate between the temperature of said heat loss surface and the temperature of said fluid at which, for at least some temperature differentials between said heat loss surface and said fluid, said rate of heat transfer is less than that which is achieved when said recirculating means is operated at a fixed rate.

2. Apparatus as described in claim 1, and wherein said heat loss surface is provided by a relatively thin barrier between adjacent fluid bodies of differing temperatures.

3. Apparatus as described in claim 2, and wherein said adjacent fluid bodies are gaseous.

4. Apparatus as described in claim 3, and wherein said adjacent fluid bodies are air.

5. Apparatus as described in claim 4, and wherein said adjacent fluid bodies are indoor air and outdoor air.

6. Apparatus as described in claim 5, and wherein said barrier comprises a window.

7. Apparatus as described in claim 1, and wherein said heat loss surface is provided by a relatively thin barrier between a fluid body and a substantial vacuum.

8. Apparatus as described in claim 7, and wherein said fluid is air.

9. Apparatus as described in claim 8, and wherein said barrier comprises a window for a spacecraft.

10. Apparatus as claimed in claim 7, and wherein one of said fluid bodies is gaseous, and the other of said fluid bodies is liquid.

11. Apparatus as described in claim 10, and wherein said heat loss surface is provided by a relatively thin barrier between the interior of a transport vessel and a liquid.

12. Apparatus as described in claim 11, and wherein said barrier comprises a window for a submersible craft.

13. Apparatus for reducing the rate of heat transfer from a constrained heat loss surface to a fluid in contact therewith, comprising:

a plurality of collectors mounted adjacent to the heat loss surface and formed for intercepting fluid displaced along said surface by forces acting in the direction of said collector in accordance with heat loss from said surface into said fluid, said collectors being disposed in an array extending outwardly from said heat loss surface;

a plurality of distributors mounted adjacent to said heat loss surface in spaced relation to said array of collectors and formed for discharging fluid for displacement along said surface to said collector, said distributors being disposed in an array extending outwardly from said heat loss surface;

a plurality of recirculating means formed for removing fluid from individual ones of said collectors and supplying such fluid to corresponding ones of said distributors; and recirculation rate control means for so controlling the rate at which said recirculating means removes said fluid from said collectors and supplies it to said distributors that the temperature of the recirculating fluid in each of said recirculating means tends to approach a temperature intermediate between the temperature of said heat loss surface and the temperature of said fluid, and determined in accordance with the position in said arrays of the collector and distributor associated with the particular recirculating means, at which intermediate temperature, for at least some temperature differentials between said heat loss surface and said fluid, said rate of heat transfer is less than that which is achieved when said recirculating means is operated at a fixed rate.

14. Apparatus as described in claim 13, and wherein said heat loss surface is provided by a relatively thin barrier between adjacent fluid bodies of differing temperatures.

15. Apparatus as described in claim 14, and wherein said adjacent fluid bodies are gaseous.

16. Apparatus as described in claim 15, and wherein said adjacent fluid bodies are air.

17. Apparatus as described in claim 16, and wherein said adjacent fluid bodies are indoor air and oudoor air.

18. Apparatus as described in claim 17, and wherein said barrier comprises a window.

19. Apparatus as described in claim 13, and wherein said heat loss surface is provided by a relatively thin barrier between a fluid body and a substantial vacuum.

20. Apparatus as described in claim 19, and wherein said fluid is air.

21. Apparatus as described in claim 20, and wherein said barrier comprises a window for a spacecraft.

22. Apparatus as described in claim 19, and wherein one of said fluid bodies is gaseous and the other of said fluid bodies is liquid.

23. Apparatus as described in claim 22, and wherein said heat loss surface is provided by a relatively thin barrier between the interior of a transport vessel and a liquid.

24. Apparatus as described in claim 23, and wherein said barrier comprises a window for a submersible craft.

* * * * *